United States Patent [19]

Weiss

[11] Patent Number: 4,946,155

[45] Date of Patent: Aug. 7, 1990

[54] OFFICE MACHINE COMPRISING A PAPER STORAGE MAGAZINE

[75] Inventor: Udo I. Weiss, Siegen, Fed. Rep. of Germany

[73] Assignee: U.S. Philips Corporation, New York, N.Y.

[21] Appl. No.: 280,611

[22] Filed: Dec. 5, 1988

[30] Foreign Application Priority Data

Dec. 5, 1987 [DE] Fed. Rep. of Germany ..... 3741311

[51] Int. Cl.[5] ..... B65H 3/44

[52] U.S. Cl. ..... 271/9; 400/624

[58] Field of Search ..... 400/624, 625, 629; 271/9, 305

[56] References Cited

U.S. PATENT DOCUMENTS

| | | | |
|---|---|---|---|
| 4,285,607 | 8/1981 | Steinhilber | 420/625 |
| 4,473,314 | 9/1984 | Imaizumi | 400/629 X |
| 4,489,931 | 12/1984 | Costa et al. | 400/625 |
| 4,594,013 | 6/1986 | Costa et al. | 400/629 X |
| 4,657,420 | 4/1987 | Kondo | 400/625 |
| 4,664,546 | 5/1987 | Runzi | 400/625 |
| 4,667,947 | 5/1987 | Costa et al. | 400/625 X |
| 4,742,287 | 5/1988 | Yokoi et al. | 400/624 |

FOREIGN PATENT DOCUMENTS

| | | |
|---|---|---|
| 2905171 | 6/1985 | Fed. Rep. of Germany . |
| 3434780 | 2/1988 | Fed. Rep. of Germany . |

*Primary Examiner*—Edgar S. Burr
*Assistant Examiner*—Ren Yan
*Attorney, Agent, or Firm*—William Squire; Thomas Briody; Jack Haken

[57] ABSTRACT

Copy machine has a paper storage magazine into which at least two paper sheet cassettes and decollation devices can be introduced which are associated with each paper sheet cassette and can be driven through individual driving motors so that a separate sheet can be fed arbitrarily from one of the driven cassettes into the office machine. The readjustment to a mode of operation with additional paper sheet cassettes can be carried out in a single manner by unskilled operators if the paper sheet cassettes (2,3,4) constitute with their associated decollation drives (5,6,7) a constructional unit, whose electrical motor terminals can be connected through connection plugs to control sleeves of the office machine (1).

3 Claims, 1 Drawing Sheet

OFFICE MACHINE COMPRISING A PAPER STORAGE MAGAZINE

BACKGROUND OF THE INVENTION

The invention relates to an office machine comprising a paper storage magazine, into which at least two paper sheet cassettes can be introduced and decollation drives which are associated with each paper sheet cassette and can be driven through individual driving motors so that a separate sheet can be fed arbitrarily from one of the driven cassettes into the office machine. The office machine may be a printing or a copying machine.

In such a device known from DE PS No. 2905171, several exchangeable cassettes can be inserted into an associated number of cassette holder units arranged on an office machine. These holder units comprise decollation devices which can be separately driven, which can be effected by associated motors. Thus, a modular construction of the paper storage magazine is obtained. The office machine can be provided according to need with a different number of magazine units. Further units may also be added afterwards to adapt the arrangement to an increasing need.

In the known case, the office machine must be readjusted by a person skilled in the art, who mounts the cassette holder units on the office machine and establishes the electrical connections.

SUMMARY OF THE INVENTION

It is an object of the invention to simplify the readjustment to a mode of operation with additional paper sheet cassettes in such a manner that the steps required to this end can be carried out by unskilled operators.

In accordance with the invention the paper sheet cassettes constitute with their associated decollation drives a constructional unit, whose electrical motor connections can be connected through connection plugs to driving sleeves of the office machine.

Such an office machine is manufactured as basic construction without a paper storage cassette. It includes the control units needed to add one or more additional cassettes, but it does not comprise the complicated decollation drives thereof. Cost for additional decollation drives need only be spent when they are necessary. For this purpose, the user need order only a corresponding number of additional cassettes, into which a complete decollation drive is already integrated. Mounting labour is not required because the additional cassettes can be inserted in the same manner as the first cassette into a holder of the office machine.

The electrical connections for the driving motors are then also established automatically according to an advantageous further embodiment of the invention in which the connection plugs are rigidly connected as insertion plugs to the cassette.

The efforts made for the decollation drives are very small if at least parts of the driving gear and/or the motor of the decollation drive are secured at one sidewall of the cassette.

A compact magazine is obtained if they adjoin each other as closely as possible, while a next cassette can be secured to a preceding cassette. The electrical connection can advantageously be estblished in such a manner that the cassettes have insertion plugs on one side, which engage each time into one of the control sleeves of the office machine provided for all the connection motors, and the insertion plugs not electrically connected to the motor terminals are connected to oppositely arranged output sleeves, which are arranged in the same spatial relationship as the control sleeves of the printing machine and are electrically connected so that the driving motors of the next cassettes can be electrically connected to the associated control sleeves of the printing machine.

DETAILED DESCRIPTION OF THE PREFERRED EMBODIMENTS

Figure 1:
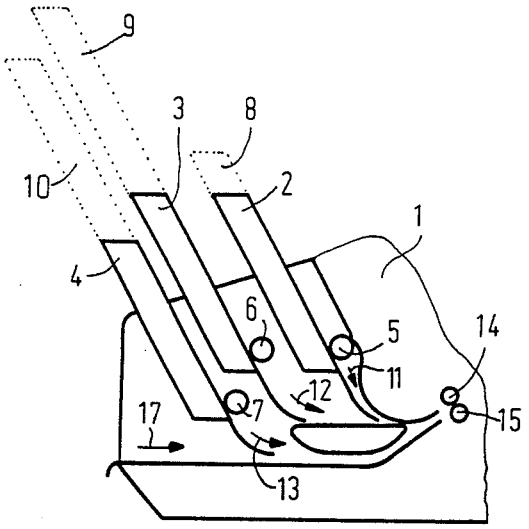
FIG. 1 shows diagrammatically the arrangement of three paper cassettes in an office machine.

In FIG. 1, only that region of an office machine 1 is shown which receives paper storage cassettes 2, 3 and 4. The decollation drives 5, 6 and 7 fixedly associated with these cassettes are only designated as decollation rollers, against which paper stacks 8, 9 and 10 are pressed.

Depending upon which of the decollation rollers is driven, a sheet of paper is transported along one of the paths 11, 12 or 13 to the feeder rollers 14 and 15 of the office machine 1. Individual sheets can manually be inserted along the path 17.

Figure 2:
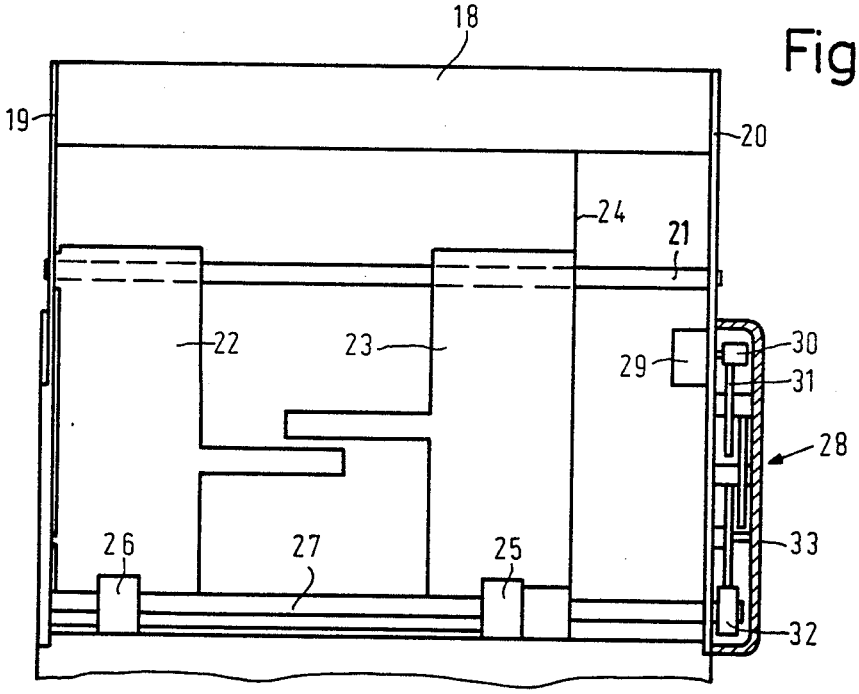
FIG. 2 is a plan view of a cassette provided with a decollation drive comprising an electric motor.

Essential details of a paper storage cassette according to the invention can be seen in FIG. 2. The cassette consists of a base plate 18 with side walls 19 and 20 formed at it. A guide shaft 21 is arranged between the side walls 19 and 20 and springs of the paper holders 22 and 23 are journalled on this shaft, the paper holder 23 being laterally displaceable. A side wall 24 as abutment stop for the decollation roller 25 is connected to the paper holder 23 so that by lateral displacement of this paper holder 23 the cassette can be adjusted to paper formats of different widths.

The resilient paper holder 23 is associated with the side wall 19. The associated decollation roller 26 is connected to the shaft 27, while the decollation roller 25 is journalled on the shaft 27 so as to be rotatably coupled to, but axially slidable on the shaft.

The side wall 20 serves as the same time to hold the elements of a driving gear 28 and of an electric motor 29, whose pinion 30 meshes with the first driving wheel 31. Through further driving wheels, which provide for a desired reduction of the speed of the motor, the toothed wheel 32 connected to the shaft 22 through a free-wheel and hence to decollation rollers 25 and 26 are driven. The free-wheel permits of pulling out the sheet of paper with a stationary driving gear.

The toothed wheels of the driving gear 28 in this example are journalled on trunnions formed on the side wall 20. The cover 33 of synthetic material consequently does not require any supporting points.

The trunnions could also be associated with the cover 33. Thus, the desired driving gear reduction can be inserted into the housing of the cassette and hence the cassette can be adapted to the desired paper formats in a simple manner by exchanging this cover together with the toothed wheels arranged on it.

Figure 3:
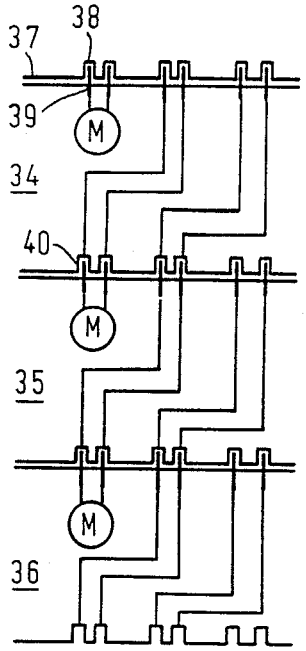
FIG. 3 shows in principle an advantageous possibility of electrical connection for three consecutively arranged cassettes.

In FIG. 3, the cassettes 34, 35 and 36 are shown, which adjoin each other directly in the same plane. Six electrical connection sleeves 38 are fixedly arranged on a wall 37 of an office machine, these sleeves supplying alternately the motor voltages for the motors M of the cassettes 34, 35 or 36.

The cassettes are shaped in the same manner and each time have six fixedly associated plugs 39 in a spatial distribution corresponding to the arrangement of the connection sleeves 38. In addition, output sleeves 40 are fixedly secured to each cassette, the plugs 39 of another cassette fitting into these output sleeves. The plugs of a cassette not connected to the motor M are connected electrically to their output sleeves 40 in a manner shown in FIG. 3. It can be seen that the motors M of the cassettes 34, 35 and 36 are electrically connected to their associated control sleeves 38 of the wall 37 of the office machine.

The first cassette 34 is to be connected directly to the office machine. The next cassettes 35 and 36 are to be secured to the preceding cassettes 34 and 35, respectively. The cassette may be inserted in an arbitrary order of succession without the drive being influenced thereby.

What is claimed is:

1. A paper storage cassette for an office machine having a magazine for removably receiving at least two cassettes and a plurality of first terminals associated with the magazine each for supplying electrical power for a drive motor, said machine including means for selecting a cassette and for feeding a sheet from that selected cassette to said machine, each cassette comprising:

storage means for holding a plurality of sheets;

decollation means for withdrawing a sheet from said storage means;

a first drive motor coupled to operate said decollation means;

connection means connected to said first drive motor and arranged to be connected to one of said first terminals for supplying electrical power to said first drive motor, said connection means including means for engaging others of said first terminals of said office machine and means for engaging the connection means on a further cassette; and conductor means connecting the connection means of each cassette in a manner so that the drive motors of second and further cassettes can be connected electrically to selected different ones of the plurality of first terminals of said office machine via the connection means and conductor means of an intervening cassette.

2. A paper storage cassette for an office machine having a magazine for removably receiving at least two cassettes and a plurality of terminals associated with the magazine, said machine including means for selecting a cassette and for feeding that sheet from a selected cassette to said machine, each cassette comprising:

storage means for holding a plurality of sheets;

decollation means for withdrawing a sheet from said storage means;

drive motor means connected to said decollation means;

first connection means connected to said drive motor means and adapted to connect with a first of said terminals for supplying electrical power to said drive motor means;

second connection means positioned for engaging a second of said terminals;

third connection means positioned and arranged to connect with the first connection means of a further cassette in said magazine; and conductor means for electrically connecting said second and third connection means of said cassette so that the drive motor of a further cassette is electrically connected to said second of said terminals.

3. The cassette of claim 2 wherein said magazine includes a third of said terminals, said cassette including a fourth connection means positioned for engaging the third of said terminals and a fifth connection mean positioned and arranged to connect with the second connection means of a further cassette, said conductor means including means for electrically connecting said fourth and fifth connection means to supply power to the second connection means of a further cassette and, thus, to the drive motor means of a still further cassette via the first connection means of a still further cassette.

* * * * *